US009719677B2

(12) United States Patent
Deng et al.

(10) Patent No.: US 9,719,677 B2
(45) Date of Patent: Aug. 1, 2017

(54) PULVERIZED COAL FIRED BOILER WITH WALL-ATTACHMENT SECONDARY AIR AND GRID OVERFIRE AIR

(71) Applicant: Yantai Longyuan Power Technology Co., Ltd., Yan Tai, Shendong (CN)

(72) Inventors: Yuankai Deng, Yan Tai (CN); Yonghe Zhang, Yan-Tai (CN); Ming Li, Yan Tai (CN); Bo Hou, Yan Tai (CN); Jinlei Cui, Yan Tai (CN); Tanrong Wei, Yan Tai (CN); Weiguo Rong, Yan Tai (CN); Lei Li, Yan Tai (CN); Guofeng Xu, Yan Tai (CN)

(73) Assignee: Yantai Longyuan Power Technology Co., Ltd., Yan Tai, Shandong (CN)

( * ) Notice: Subject to any disclaimer, the term of this patent is extended or adjusted under 35 U.S.C. 154(b) by 365 days.

(21) Appl. No.: 14/357,733

(22) PCT Filed: Jan. 15, 2013

(86) PCT No.: PCT/CN2013/070458
§ 371 (c)(1),
(2) Date: May 12, 2014

(87) PCT Pub. No.: WO2014/008758
PCT Pub. Date: Jan. 16, 2014

(65) Prior Publication Data

US 2014/0308620 A1 Oct. 16, 2014

(30) Foreign Application Priority Data

Jul. 10, 2012 (CN) ..... 2012 1 0236354

(51) Int. Cl.
*F23C 1/00* (2006.01)
*F23D 1/00* (2006.01)
(Continued)

(52) U.S. Cl.
CPC ..... *F23D 1/005* (2013.01); *F23C 5/32* (2013.01); *F23C 7/02* (2013.01); *F23J 3/00* (2013.01); *F23L 9/02* (2013.01); *F23L 9/04* (2013.01)

(58) Field of Classification Search
CPC ..... F23C 5/00
(Continued)

(56) References Cited

U.S. PATENT DOCUMENTS 4,655,148 A * 4/1987 Winship ..... F23L 9/02 110/264
5,020,454 A * 6/1991 Hellewell ..... F23C 1/00 110/264
(Continued)

FOREIGN PATENT DOCUMENTS

CN 1786564 A 6/2006
CN 101598333 A 12/2009
(Continued)

OTHER PUBLICATIONS

Notification of the First Office Action, mailed Sep. 18, 2013, issued in corresponding Chinese Application No. 201210236354.7, filed Jul. 10, 2012, 9 pages.
(Continued)

*Primary Examiner* — Avinash Savani
(74) *Attorney, Agent, or Firm* — Christensen O'Connor Johnson Kindness PLLC

(57) ABSTRACT

The present invention relates to a pulverized coal fired boiler with wall-attachment secondary air and grid overfire air. Primary burners including primary air spouts, secondary air spouts and close coupled overfire air spouts arranged at intervals along the height direction of a hearth are arranged on four corners of the hearth. Two-way wall-attachment secondary air spouts and one-way wall-attachment second-
(Continued)

ary air spouts are arranged from bottom to top in a primary combustion zone where the primary burners are located. One-way wall-attachment secondary air spouts are arranged in a reduction zone between the primary burners and the top overfire air spouts, and grid overfire air spouts are arranged in a burnout zone where the overfire air is supplied. By adopting the pulverized coal fired boiler with wall-attachment secondary air and grid overfire air according to the present invention, the NO amount generated in the hearth is reduced, the NO reduction rate along a flame is improved, the coke burnout rate is improved, less coke which is not burnt out enters into the burnout zone, slagging on the water-cooled wall is reduced, and ultralow emission of NOx may be realized on the premise that the combustion efficiency is not reduced, slag is not agglomerated in the hearth and the flue gas temperature deviation is small.

14 Claims, 5 Drawing Sheets

(51) Int. Cl.

| | |
|---|---|
| ***F23L 9/02*** | (2006.01) |
| ***F23L 9/04*** | (2006.01) |
| ***F23C 5/32*** | (2006.01) |
| ***F23C 7/02*** | (2006.01) |
| ***F23J 3/00*** | (2006.01) |

(58) Field of Classification Search
USPC ..... 431/177; 110/234, 265
See application file for complete search history.

(56) References Cited

U.S. PATENT DOCUMENTS

| | | | | |
|---|---|---|---|---|
| 5,950,574 | A * | 9/1999 | Matsuda | F22B 21/343 122/460 |
| 7,624,707 | B2 | 12/2009 | LaRue | |
| 2010/0212556 | A1 | 8/2010 | Swanson | |

FOREIGN PATENT DOCUMENTS

| | | | |
|---|---|---|---|
| CN | 102454982 | A | 5/2012 |
| CN | 102721043 | A | 10/2012 |

OTHER PUBLICATIONS

Yusen, Bi, "Present Status of Low-$NO_X$ Combustion Technology," Thermal Power Generation (2), 1994-2010 China Academic Journal Electronic Publishing House, Mar. 2000, 18 pages.

* cited by examiner

PULVERIZED COAL FIRED BOILER WITH WALL-ATTACHMENT SECONDARY AIR AND GRID OVERFIRE AIR

FIELD OF THE INVENTION

The present invention relates to the technical field of boiler combustion, in particular to a pulverized coal fired boiler with wall-attachment secondary air and grid overfire air.

BACKGROUND OF THE INVENTION

An air staged combustion technology is widely adopted in the technical field of low $NO_X$ combustion of coal boilers at present. Known from searching the documents related to the prior art, "Present Status of Low-NOx Combustion Technology" (Bi Yusen, Thermal Power Generation, 2000, No.2) introduced an integrated air-staged direct flow burner and coaxial combustion systems CFS I and CFS II of a tangential fired boiler developed by ABB-CE Company in detail, and on this basis, a low $NO_X$ combustion system of separated over fire air (SOFA) or close coupled over fire air (CCOFA) is added.

Oxygen-deficiency reductive combustion is implemented in a primary burner zone, the excess air coefficient is less than 1, and the remaining secondary air is supplied through overfire air, so that air staged combustion is realized and the objective of reducing the production amount of $NO_X$ is fulfilled. When the technology is used for bituminous coal and lean coal fired boilers, emission of $NO_X$ may reach 250-650 mg/Nm$^3$. However, the technology has shortcomings. Through the CFS I and CFS II technologies, primary air jet flow and secondary air jet flow injected into the furnace center form a coaxial positive-negative double-tangential combustion mode in opposite directions or the same direction, but because the adjacent primary air jet flow and deflecting secondary air jet flow entrain each other, a part of secondary air enters a coal volatile matter separation and combustion zone to generate $NO_X$. The primary combustion zone presents a reductive atmosphere, so that slagging and high-temperature corrosion are aggravated.

The emission of NO may be reduced by adding the height of the separated over fire air (SOFA) or increasing the amount of the separated over fire air (SOFA), but the combustion efficiency is reduced, the flue gas temperature of a hearth outlet rises, and the flue gas temperature deviation is increased. By adopting multistage corner-placed or wall-type tangential jet overfire air, the combustion efficiency is improved, and at the same time, because the air enters a "center zone" to make NO reductive matters such as HCN, CO and $NH_i$ etc. gathered in the "center zone" of the hearth be converted into NO, the reduction rate of NO in a reduction zone is reduced. By adopting such centralized tangential jet overfire air, the rising high-temperature flue gas inevitably revolves, so that air distribution and air speed in an burnout zone are non-uniform, coal ash granules are easily settled on the heating surface of the cross section of the hearth in the this zone, and a centralized high-temperature combustion zone is easily formed to cause slagging in this zone or upward movement of slagging to a platen superheater zone.

SUMMARY OF THE INVENTION

A technical problem to be solved by the present invention is to provide a pulverized coal fired boiler with wall-attachment secondary air and grid overfire air, which can reduce $NO_X$ emission of a hearth, reduce slagging and high-temperature corrosion and improve the combustion efficiency.

A pulverized coal fired boiler with wall-attachment secondary air and grid overfire air includes a hearth 1 and a water-cooled wall 2, wherein a platen superheater 3 is arranged on the top of the hearth 1, and the hearth 1 is provided with a primary combustion zone 111, a reduction zone 112 and a burnout zone 113 from bottom to top, wherein primary burners 4 are arranged in the primary combustion zone 111; grid overfire air spouts 8 are arranged on the water-cooled wall 2 above the primary burners 4; the reduction zone 112 is a zone between the top of the primary burners 4 and the bottom of the grid overfire air spouts 8; the burnout zone 113 is a zone between the grid overfire air spouts 8 and the bottom of the platen superheater 3; a group of primary burners 4 is arranged on each of four corners of the hearth of the primary combustion zone 111; each group of primary burners 4 includes primary air spouts 6 and secondary air spouts 7 alternately arranged on the water-cooled wall 2 in the height direction of the hearth 1, and close coupled overfire air spouts 5 are arranged on the water-cooled wall 2 above top secondary air spouts 7, wherein the extension lines of the center lines of the primary air spouts 6 and the secondary air spouts 7 in the same height and the extension lines of the center lines of close coupled overfire air spouts 5 are respectively tangent to an imaginary circle of each layer in the center of the hearth 1 of the primary combustion zone 111; primary combustion zone two-way wall-attachment secondary air spouts 11 and primary combustion zone one-way wall-attachment secondary air spouts 10 are arranged on the water-cooled wall 2 in the primary combustion zone 111; and reduction zone one-way wall-attachment secondary air spouts 9 are arranged on the water-cooled wall 2 in the reduction zone 112.

According to an embodiment of the pulverized coal fired boiler with wall-attachment secondary air and grid overfire air of the present invention, it is further provided with at least three layers of primary air spouts 6 and secondary air spouts 7, wherein the lowest layer is the first layer; and one or more layers of primary combustion zone two-way wall-attachment secondary air spouts 11 are arranged on the water-cooled wall 2 between the first layer of primary air spouts $Y_1$ and the third layer of primary air spouts $Y_3$.

According to an embodiment of the pulverized coal fired boiler with wall-attachment secondary air and grid overfire air of the present invention, it is further provided with one or more layers of primary combustion zone two-way wall-attachment secondary air spouts 11, wherein each layer of primary combustion zone two-way wall-attachment secondary air spouts 11 includes four primary combustion zone two-way wall-attachment secondary air spouts 11, and one primary combustion zone two-way wall-attachment secondary air spout 11 is arranged at the same elevation of each wall of the water-cooled wall 2; and the speed of air spouted from the primary combustion zone two-way wall-attachment secondary air spouts 11 is more than 40 m/s. The amount of air passing through the four primary combustion zone two-way wall-attachment secondary air spouts 11 of each layer is 1 to 3% of the total amount of the secondary air of the boiler.

According to an embodiment of the pulverized coal fired boiler with wall-attachment secondary air and grid overfire air of the present invention, further, air outlet nozzles of the primary combustion zone two-way wall-attachment secondary air spouts 11 are symmetrically arranged on the left and right sides of a center line which is the normal of the water-cooled wall 2; the angles between the center lines of the air outlet nozzles and the normal of the water-cooled wall 2 are $\alpha_{left}$ and $\alpha_{right}$ respectively, wherein $\alpha_{left}$ is equal to $\alpha_{right}$; and the adjustment range of the center lines of the air outlet nozzles is $15° \leq \alpha_{left} \leq 80°$.

According to an embodiment of the pulverized coal fired boiler with wall-attachment secondary air and grid overfire air of the present invention, further, at least three layers of primary combustion zone one-way wall-attachment secondary air spouts 10 are arranged between the third layer of primary air spouts $Y_3$ and the close coupled overfire air spouts 5 on the water-cooled wall 2 on two sides of the secondary air spouts 7 and the close coupled overfire air spouts 5, wherein the primary combustion zone one-way wall-attachment secondary air spouts 10 of each layer are arranged at the same elevation of the water-cooled wall 2, and two spouts are symmetrically arranged relative to the secondary air spouts 7 and the close coupled overfire air spouts 5; and the speed of air spouted from the primary combustion zone one-way wall-attachment secondary air spouts 10 is more than 35 m/s.

According to an embodiment of the pulverized coal fired boiler with wall-attachment secondary air and grid overfire air of the present invention, further, an angle β is formed between the center lines of the primary combustion zone one-way wall-attachment secondary air spouts 10 and the water-cooled wall 2, and the adjustment range of the angle β is $0° \leq \beta \leq 20°$.

According to an embodiment of the pulverized coal fired boiler with wall-attachment secondary air and grid overfire air of the present invention, further, at least one layer of the reduction zone one-way wall-attachment secondary air spouts 9 is arranged on the water-cooled wall 2 in the reduction zone 112, wherein the heights of the reduction zone one-way wall-attachment secondary air spouts 9 of the same layer are the same, and two reduction zone one-way wall-attachment secondary air spouts 9 are symmetrically arranged on each corner of the water-cooled wall 2; and the speed of air spouted from the reduction zone one-way wall-attachment secondary air spouts 9 is 25 to 50 m/s. The amount of air passing through each layer of the reduction zone one-way wall-attachment secondary air spouts 9 is 1.5 to 3% of the total amount of the secondary air.

According to an embodiment of the pulverized coal fired boiler with wall-attachment secondary air and grid overfire air of the present invention, further, an angle β' is formed between the center lines of the reduction zone one-way wall-attachment secondary air spouts 9 and a wall surface of the water-cooled wall 2; and wherein the adjustment range of the angle β' is $0° \leq \beta' \leq 15°$.

According to an embodiment of the pulverized coal fired boiler with wall-attachment secondary air and grid overfire air of the present invention, further, at least two layers of the grid overfire air spouts 8 are arranged on the water-cooled wall 2 in the burnout zone 113; and at least three grid overfire air spouts 8 of each layer are arranged at the same height of each wall of the water-cooled wall 2; and the center lines of the grid overfire air spouts 8 are perpendicular to the wall surface of the water-cooled wall 2 where the grid overfire air spouts 8 are located.

According to an embodiment of the pulverized coal fired boiler with wall-attachment secondary air and grid overfire air of the present invention, further, the distance between the center lines of the adjacent grid overfire air spouts 8 positioned on the first wall of the water-cooled wall 2 and in the same layer is equal to the distance between the center line of the grid overfire air spout 8 closest to the second wall of the water-cooled wall 2 and the second wall of the water-cooled wall 2, wherein the first wall of the water-cooled wall 2 is perpendicular to the second wall of the water-cooled wall 2.

According to an embodiment of the pulverized coal fired boiler with wall-attachment secondary air and grid overfire air of the present invention, further, the ratio of the distance $h_R$ between the center line of the grid overfire air spout 8 closest to the bottom of the platen superheater 3 and the center line of the top layer of primary air spouts $Y_6$ to the distance $h_P$ between the bottom of the platen superheater 3 and the center line of the top layer of primary air spouts $Y_6$ is 2.5:3 to 1.5:3; and the intervals of the grid overfire air spouts 8 of each layer are more than or equal to 0.5 meter.

According to an embodiment of the pulverized coal fired boiler with wall-attachment secondary air and grid overfire air of the present invention, further, an angle γ is formed between the center lines of the grid overfire air spouts 8 and the normal of the wall surface of the water-cooled wall 2; and the grid overfire air spouts 8 are downwards adjustable within a range of $0° \leq \gamma \leq 20°$.

According to an embodiment of the pulverized coal fired boiler with wall-attachment secondary air and grid overfire air of the present invention, further, the total amount of air passing through each layer of the grid overfire air spouts 8 is 5 to 25% of the total amount of air required by combustion in the boiler; and the speed of air spouted from the grid overfire air spouts 8 is 20 to 50 m/s.

According to an embodiment of the pulverized coal fired boiler with wall-attachment secondary air and grid overfire air of the present invention, further, the grid overfire air spouts (8), the primary combustion zone two-way wall-attachment secondary air spouts (11), the primary combustion zone one-way wall-attachment secondary air spouts (10) and the reduction zone one-way wall-attachment secondary air spouts (9) operate at the same time.

By adopting the pulverized coal fired boiler with wall-attachment secondary air and grid overfire air of the present invention, the amount of secondary air entering the "center zone" of the hearth where high-concentration reductive NO matters such as HCN, $NH_i$ and CO are gathered from bottom to top along a passing path and the amount of secondary air entering the volatile matter separation and combustion zone on four corners of the hearth are reduced, so that a proper amount of secondary air enters a "near wall zone" where coke is gathered in good time, the $NO_X$ emission from the hearth may be reduced, and the combustion efficiency is improved; and a water-cooled wall surface with low-temperature, high-oxygen and low-solid phase concentration property is formed, so that slagging resistance and high-temperature corrosion resistance of the water-cooled wall are improved. The pulverized coal fired boiler with wall-attachment secondary air and grid overfire air of the present invention has the following characteristics:

1. the efficiency of the boiler will keep up, and on the premise that slagging and high-temperature corrosion do not occur in the boiler, the $NO_X$ emission concentration of the tangential fired boiler may reach 80 mg/Nm$^3$-180 mg/Nm$^3$ when bituminous coal is fired and 280-380 mg/Nm$^3$ when lean coal is fired;

2. the flue gas temperature deviation of the hearth outlet of the II-shaped boiler is less than 30° C., and the flue gas temperature of the hearth outlet is not higher than a design value.

BRIEF DESCRIPTION OF THE DRAWINGS

In order to explain the technical solution of an embodiment of the present invention and prior art more clearly, drawings used for description of the embodiment and prior art will be briefly introduced as follows. Obviously, the following drawings concern some embodiments of the present invention only. Based on these drawings, one person skilled in the art could educe any other drawings without any creative activities.

DETAILED DESCRIPTION OF THE EMBODIMENTS

Figure 1A:
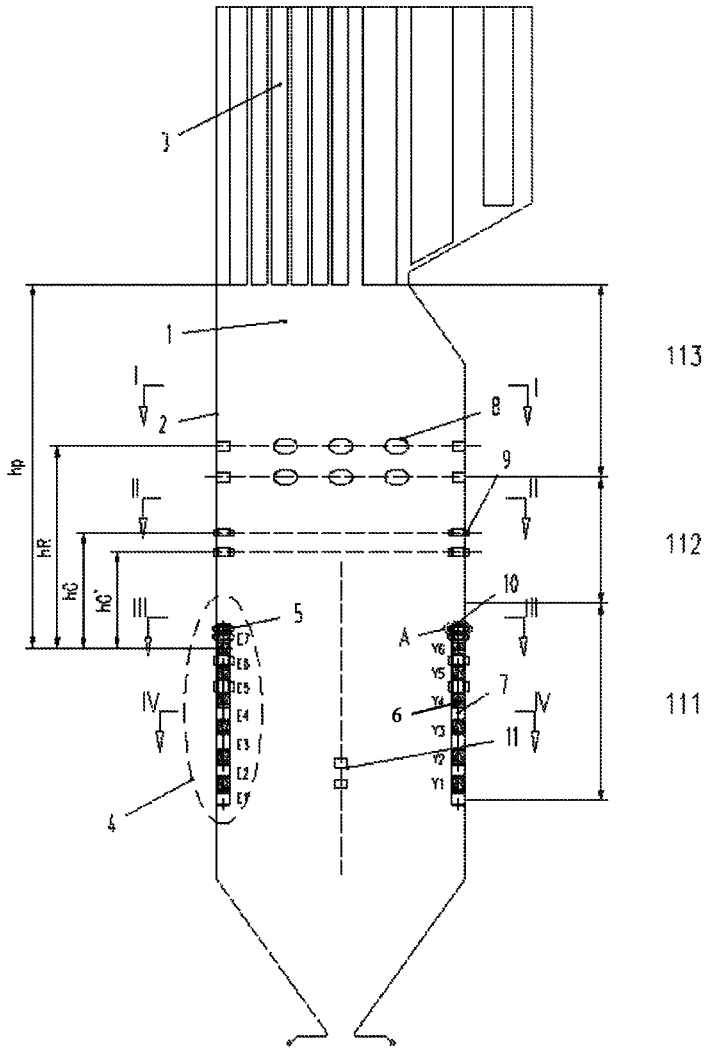
FIG. 1A is a schematic diagram of an embodiment of a pulverized coal fired boiler with wall-attachment secondary air and grid overfire air according to the present invention.

Referring to the drawings, the present invention will be explained more comprehensive as follows, wherein the exemplary embodiment will be described. The technical solution of the embodiments of the present invention will be clearly and completely described according to the figure of the embodiments. Obviously, the embodiments described herein are some embodiments of the present invention, but not all embodiments. Any other embodiments educed by one person skilled in the art based on the embodiments described herein without any creative activities should fall into the protection scope of this invention. The technical solution of the present invention will be described from various aspects below in conjunction with the drawings and the embodiments.

In view of the deficiencies in prior art, the present invention provides a pulverized coal fired boiler with wall-attachment secondary air and grid overfire air, which reduces the amount of secondary air entering a "center zone" of a hearth where high-concentration reductive NO matters such as HCN, $NH_i$ and CO are gathered from bottom to top along a passing path and the amount of secondary air entering a volatile matter separation and combustion zone on four corners of the hearth, so that a proper amount of secondary air enters a "near wall zone" where coke is gathered in good time, the coke burnout rate and the NO reduction rate in the zone of the hearth from bottom to top along the passing path are improved, little coke enters an burnout zone, and the overfire air may be arranged at the higher position of the hearth. The grid overfire air at the higher position is arranged in the burnout zone, and grid formed by the grid overfire air covers multiple "small vortexes" on the cross section of the hearth, so that the coke and the air are mixed uniformly, the residence time of the coke is prolonged, the burnout rate of the coke is improved, and the production amount of NO is reduced. The wall-attachment secondary air and flue gas flow rising in the center zone are blended to enlarge the wall-cooled wall surface with low-temperature, high-oxygen and low-solid phase concentration property in a primary combustion zone and a reduction zone, so that slagging resistance and high-temperature corrosion resistance of a wall-cooled wall are improved.

The pulverized coal fired boiler with wall-attachment secondary air and grid overfire air of the present invention may effectively fulfill three objectives of reducing $NO_X$ emission of the hearth, improving the combustion efficiency and avoiding slagging and high-temperature corrosion of the hearth.

Figure 1B:
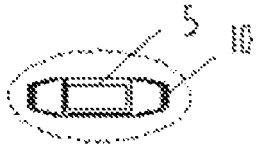
FIG. 1B is a partial enlarged schematic diagram of A marked in FIG. 1A.
Figure 1C:
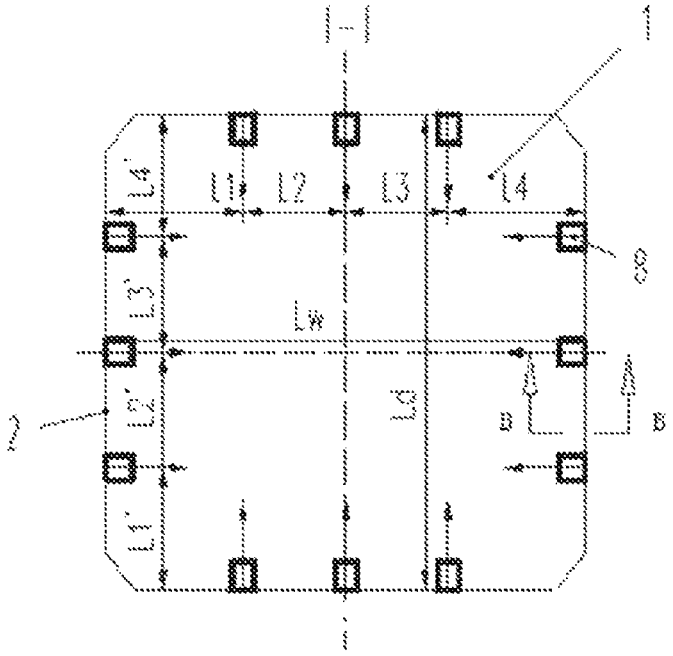
FIG. 1C is a schematic diagram of the arrangement of grid overfire air spouts of an embodiment of the pulverized coal fired boiler with wall-attachment secondary air and grid overfire air according to the present invention, and is an I-I section view of FIG. 1A.
Figure 1D:
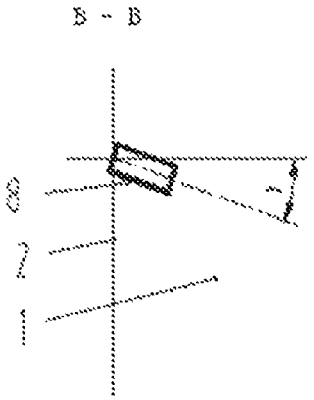
FIG. 1D is a partial schematic diagram of a grid overfire air spout of an embodiment of the pulverized coal fired boiler with wall-attachment secondary air and grid overfire air according to the present invention, and is a B-B section view of FIG. 1C.
Figure 1E:
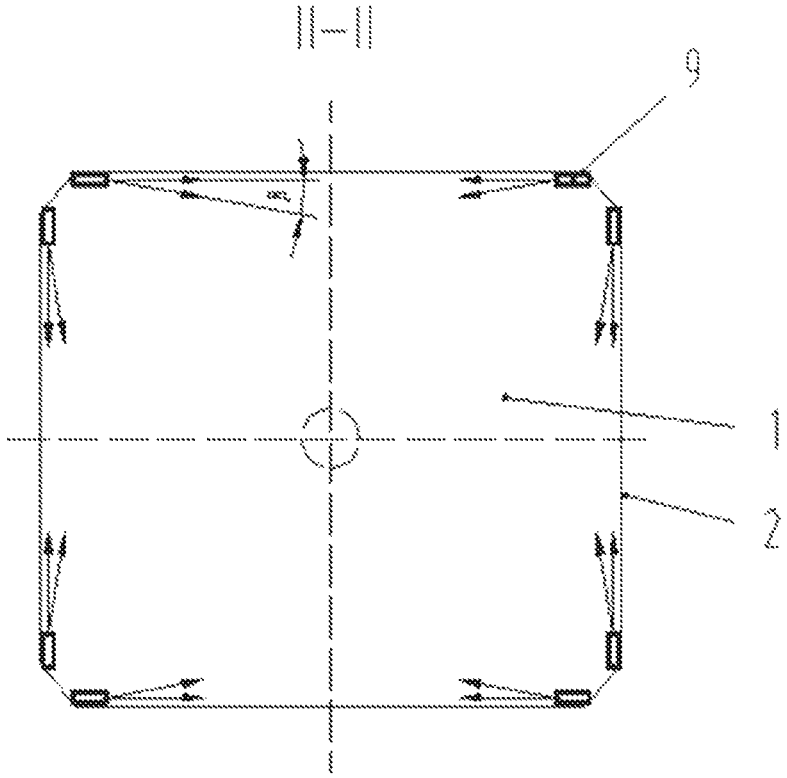
FIG. 1E is a schematic diagram of the arrangement of reduction zone one-way wall-attachment secondary air spouts of an embodiment of the pulverized coal fired boiler with wall-attachment secondary air and grid overfire air according to the present invention, and is a II-II section view of FIG. 1A.
Figure 1F:
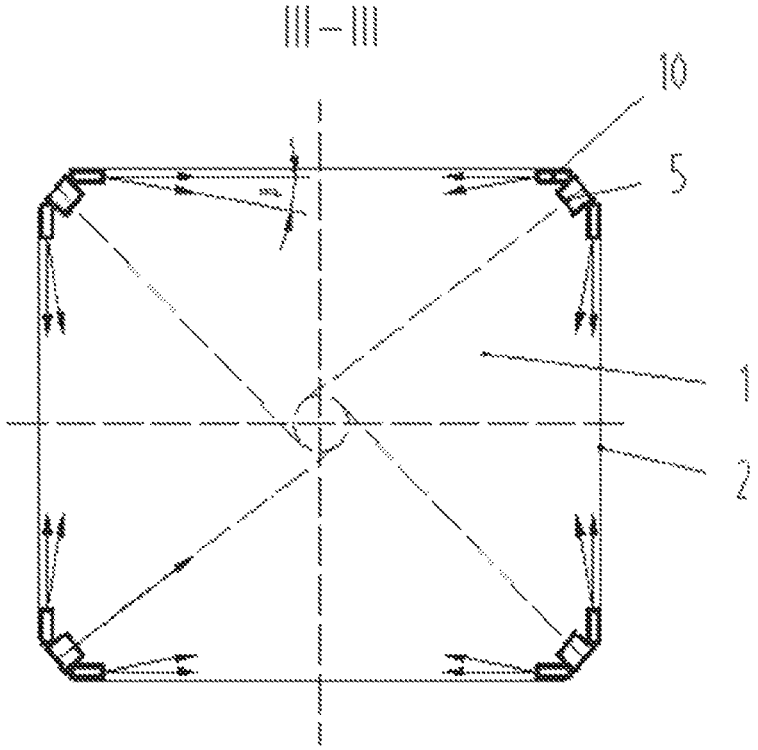
FIG. 1F is a schematic diagram of the arrangement of primary combustion zone one-way wall-attachment secondary air spouts of an embodiment of the pulverized coal fired boiler with wall-attachment secondary air and grid overfire air according to the present invention, and is a III-III section view of FIG. 1A.
Figure 1G:
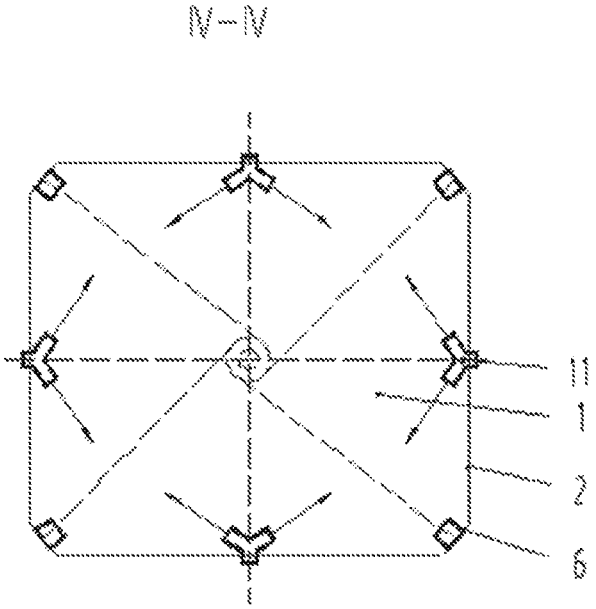
FIG. 1G is a schematic diagram of the arrangement of primary combustion zone two-way wall-attachment secondary air spouts of an embodiment of the pulverized coal fired boiler with wall-attachment secondary air and grid overfire air according to the present invention, and is a IV-IV section view of FIG. 1A.
Figure 1H:
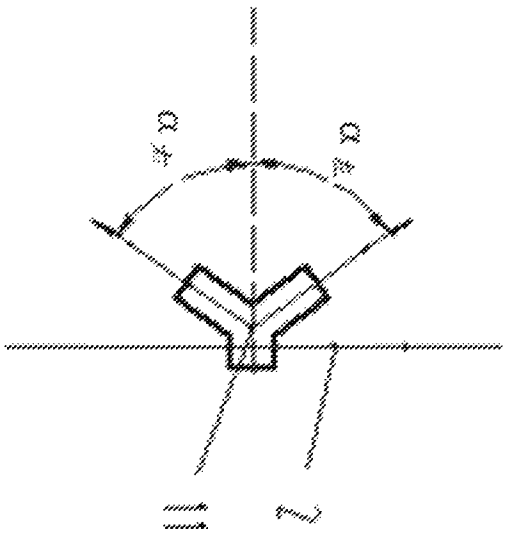
FIG. 1H is a partial enlarged schematic diagram of a primary combustion zone two-way wall-attachment secondary air spout of an embodiment of the pulverized coal fired boiler with wall-attachment secondary air and grid overfire air according to the present invention.

FIG. 1A to 1H are a schematic diagram of an embodiment of a pulverized coal fired boiler with wall-attachment secondary air and grid overfire air according to the present invention and schematic diagrams of the arrangement of different spouts. As shown in the diagrams, the pulverized coal fired boiler with wall-attachment secondary air and grid overfire air includes a hearth 1 and a water-cooled wall 2, and the hearth 1 is provided with a primary combustion zone 111, a reduction zone 112 and a burnout zone 113 from bottom to top. Primary burners 4 are arranged in the primary combustion zone 111 (the positions of the primary burners 4 and various spouts of the primary burners 4 are marked in the figures, and remaining parts of the primary burners are not drawn in the figures). The reduction zone 112 is a zone between the top of the primary burners 4 and the bottom of grid overfire air spouts 8. The burnout zone 113 is a zone between the grid overfire air spouts 8 and the bottom of a platen superheater 3. A group of primary burners 4 is arranged on each of four corners of the primary combustion zone 111 in the hearth. Each group of primary burners 4 includes primary air spouts 6 (the primary air spouts 6 are sequentially numbered as $Y_1$, $Y_2$, $Y_3$, $Y_4$, $Y_5$ and $Y_6$ from bottom to top) and secondary air spouts 7 (the secondary air spouts 7 are sequentially numbered as $E_1$, $E_2$, $E_3$, $E_4$, $E_5$, $E_6$ and $E_7$ from bottom to top) arranged at intervals on the water-cooled wall 2 in the height direction, and a close coupled overfire air spout 5 is arranged on the water-cooled wall 2 above each top secondary air spout 7. The grid overfire air spouts 8 are arranged on the water-cooled wall 2 in the burnout zone 113 respectively. The extension lines of the center lines of the primary air spouts 6 and the secondary air spouts 7 in the same height and each close coupled overfire air spout 5 are formed on the imaginary tangent circle of each layer in the center of the hearth of the primary combustion zone 111 respectively.

Primary combustion zone two-way wall-attachment secondary air spouts 11 and primary combustion zone one-way wall-attachment secondary air spouts 10 are arranged on the water-cooled wall 2 in the primary combustion zone 111. Reduction zone one-way wall-attachment secondary air spouts 9 are arranged on the water-cooled wall 2 in the reduction zone 112.

In the primary combustion zone, at least two layers of two-way adjustable wall-attachment secondary air spouts are arranged on the vertical center lines of four walls of the water-cooled wall in a zone between the center lines of the bottom primary air spouts and the center lines of the upward third layer of primary air spouts, and the angles between the jet spouts on two sides and the normal of the water-cooled wall are adjusted within a range of 15 to 80°. The passing secondary air is far away from the corners where the primary burners are located, so that the secondary air is prevented from entering a volatile matter separation and combustion zone, and air in the middle zone of the hearth where the low-speed deflecting secondary air jet flow can not enter and coke is combusted collectively is supplemented. Secondary air jet outer layer air spouted by the spouts on two sides from this part of secondary air is gradually blended to a coke gathering zone from the flame border of the middle zone and seldom enters into the "center zone" where reductive NO such as HCN, CO, $NH_t$ etc. are gathered. The blending initial point and blending strength of the secondary air are determined by adjusting the air speed and angle of the spouts. The wall-attachment secondary air and flue gas flow rising in the center zone are blended to enlarge the wall-cooled wall surface area with low-temperature, high-oxygen and low-solid phase concentration property in the primary combustion zone and the reduction zone, so that slagging resistance and high-temperature corrosion resistance of the wall-cooled wall are improved.

At least three layers of primary combustion zone one-way wall-attachment secondary air spouts 10 are arranged in the zone between the primary air spouts $Y_3$ of the third layer and the close coupled overfire air spouts 5 in the primary combustion zone 111 and on the water-cooled wall 2 on two sides of the secondary air spouts and the close coupled overfire air spouts 5, each layer is on four walls, and two spouts are arranged on the same elevation of the same wall in a countering mode. The secondary air jet outer layer air spouted from the spouts is gradually blended to the coke gathering zone from the flame border of the primary combustion zone and seldom enters the "center zone" where HCN, CO, $NH_1$ and the like of reductive NO are gathered. The blending initial point and blending strength of the secondary air are determined by adjusting the air speed and angle of the spouts. The wall-attachment secondary air and the flue gas flow rising in the center zone are blended to enlarge the wall-cooled wall surface area with low-temperature, high-oxygen and low-solid phase concentration property in the primary combustion zone, so that slagging resistance and high-temperature corrosion resistance of the wall-cooled wall are improved.

At least one layer of one-way adjustable wall-attachment secondary air spouts is upwards arranged on the four walls of the water-cooled wall of the reduction zone along the height direction of the hearth.

The outer layer air of the secondary air jet spouted from these spouts enters the near wall coke gathering zone from the flame border of the near wall zone of the reduction zone and seldom enters the center zone. The wall-attachment secondary air and the flue gas flow rising in the center zone are blended to enlarge the water-cooled wall surface area with low-temperature, high-oxygen and low-solid phase concentration property in the reduction zone, so that slagging resistance and high-temperature corrosion resistance of the wall-cooled wall are improved.

A flow field formed by blending vertical upward flue gas flow in the reduction zone with near wall zone "small vortexes" formed by one-way wall-attachment secondary air spout jet flow prolongs the residence time of coke in the rising fired flue gas near wall zone, and strengthens blending of the air and oxygen.

Research shows that, the coke concentrated in the appropriate oxygen environment of the near wall zone is combusted and reduces the NO at the same time, part of the coke is oxidized into NO, and NO is gathered to the "center zone" and reduced by the reductive matters such as HCN, CO and $NH_1$ in the "center zone". Therefore, through such arrangement of the one-way adjustable wall-attachment secondary air spouts in the reduction zone, the reducing capability of the NO in the reduction zone, the burnout rate of the coke and the slagging resistance and high-temperature corrosion resistance of the water-cooled wall are improved.

Since the burnout rate of the coke on the upstream part of the burnout zone along the passing path is improved, the amount of un-burnt coke entering the overfire air zone in upper portion of the hearth is reduced, so that the problems such as flue gas temperature rise of the hearth outlet due to centralized combustion of more coke in the upper higher zone of the hearth, increase of NO generated by the coke on the upper part of the hearth and so on are avoided, and the upper overfire air spouts may be arranged at the positions closer to the platen superheater to enlarge the reduction zone.

At least two layers of grid overfire air spouts are arranged on the four walls of the burnout zone, at least three elliptical spouts are arranged on each wall of each layer and are downwards adjustable within a range of 0 to 10°, and the air speed of the spouts may be separately adjusted. Big "vortexes" formed when upstream flue gas rises become many grid-like small "vortexes" through such arrangement of the overfire air spouts, the air in this zone is distributed uniformly, uniform blending of the coke and a proper amount of air is strengthened, and the residence time of the coke is prolonged, so that the burnout rate of the coke is improved, the NO production amount of the coke is reduced, the flue gas speed field at the hearth outlet is uniform, and the flue gas temperature deviation at the hearth outlet is reduced.

According to an embodiment of the present invention, at least two layers of primary combustion zone two-way wall-attachment secondary air spouts 11 are arranged on the vertical center lines of the four walls of the water-cooled wall 2 between the bottom layer of primary air spouts $Y_1$ and the upward third layer of primary air spouts $Y_3$. For example, two layers of primary combustion zone two-way wall-attachment secondary air spouts 13 are disposed, have the same elevations as the primary air spouts $Y_1$ and $Y_2$ respectively and are positioned on the vertical center lines of the four walls.

Each layer includes four primary combustion zone two-way wall-attachment secondary air spouts 11, and one primary combustion zone two-way wall-attachment secondary air spout 11 is arranged at the same elevation of each wall of the water-cooled wall 2; and the amount of air passing through the four primary combustion zone two-way wall-attachment secondary air spouts 11 of each layer is 1% to 3% of the total amount of the secondary air of the boiler, and the speed of the spouted air is more than 40 m/s.

Outlet nozzles of the primary combustion zone two-way wall-attachment secondary air spouts 11 are symmetrically arranged on the left and right sides of a center line which is the normal of the water-cooled wall 2; the angles between the center lines of the outlet nozzles and the normal of the water-cooled wall are $\alpha_{left}$ and $\alpha_{right}$ respectively, wherein $\alpha_{left}$ is equal to $\alpha_{right}$; and the adjustment range of the center lines of the outlet nozzles is $15° \leq \alpha_{left}$ and $\alpha_{right} \leq 80°$.

According to an embodiment of the present invention, at least three layers of primary combustion zone one-way wall-attachment secondary air spouts 10 are arranged in a zone between the third layer of primary air spouts $Y_3$ and the close coupled overfire air spouts 7 in the primary combustion zone 111 and on the water-cooled wall 2 on two sides of the secondary air spouts and the close coupled overfire air spouts 7, each layer is arranged on the four walls, and two spouts are symmetrically arranged on the same elevation of the same wall. For example, totally four layers of primary combustion zone one-way wall-attachment secondary air spouts 11 are positioned from bottom to top on two sides of the secondary air spouts $E_4$, $E_5$ and $E_6$ and the close coupled overfire air spouts 5, and the center line of each spout has the same elevation as the center lines of the adjacent secondary air spouts $E_4$, $E_5$ and $E_6$ and close coupled overfire air spouts 5. The two spouts on the same wall are arranged in a countering mode. An angle β is formed between the center lines of the primary combustion zone one-way wall-attachment secondary air spouts 10 and the water-cooled wall 2, and the adjustment range of the angle β is $0° \leq \beta \leq 20°$. The speed of air spouted from each layer of primary combustion zone one-way wall-attachment secondary air spouts 10 is more than 35 m/s.

According to an embodiment of the present invention, at least one layer of reduction zone one-way wall-attachment secondary air spouts 9 is arranged on the four walls of the water-cooled wall 2 in the reduction zone 112. For example, at least two layers of reduction zone one-way wall-attachment secondary air spouts 11 are arranged on four corners of the reduction zone 112 of the hearth 1, each layer of spouts has the same elevation on the four walls, two spouts are arranged on each wall in a countering mode, the ratio of the distance hG between the center line of the lower layer of reduction zone one-way wall-attachment secondary air spouts 11 close to the top primary air spouts $Y_6$ and the center line of the top primary air spouts $Y_6$ to the distance hp between the center line of the top primary air spouts $Y_6$ and the bottom of the platen superheater is 1:7, and the ratio of the distance hG' between the center line of the upper layer of reduction zone wall-attachment secondary air spouts 11 adjacent to the lower layer of reduction zone one-way wall-attachment secondary air spouts 11 and the center line of the top primary air spouts $Y_6$ to the distance hp between the center line of the top primary air spouts and the bottom of the platen superheater is 1:3.

Each layer of reduction zone one-way wall-attachment secondary air spouts 9 is arranged on the four corners of the hearth 1 with the same elevation, and two reduction zone one-way wall-attachment secondary air spouts 9 are symmetrically arranged on each corner of the hearth 1. An angle β' is formed between the center lines of the reduction zone one-way wall-attachment secondary air spouts 9 and the water-cooled wall 2, and the adjustment range of the angle β' is $0° \leq \beta' \leq 15°$. The amount of air passing through each layer of the reduction zone one-way wall-attachment secondary air spouts 9 is 1.5 to 3% of the total amount of the secondary air; and the speed of air spouted from the reduction zone one-way wall-attachment secondary air spouts 9 is 25 to 50 m/s.

According to an embodiment of the present invention, at least two layers of countering grid overfire air spouts 8 are arranged on the water-cooled wall 2 in the burnout zone 113. For example, two layers of burnout zone grid overfire air spouts 10 are arranged in the burnout zone 113, three spouts with the same elevation are arranged on each wall, wherein each wall is provided with one spout on the vertical center line, on either adjacent side of which one spout is arranged, the distance between the two adjacent spouts is equal, namely $L_1=L_2=L_3=L_4$, and the distance between the spouts on the front and rear walls is ¼ boiler width, namely $L=\frac{1}{4}L_W$. The distance between the spouts on the left and right walls is ¼ boiler depth, namely $L=\frac{1}{4}L_D$. The ratio of the distance $h_R$ between the center line of the layer of grid overfire air spouts 8 closest to the bottom of the platen superheater 3 and the center line of the top layer of primary air spouts $Y_6$ to the distance hp between the bottom of the platen superheater 3 and the center line of the top layer of primary air spouts $Y_6$ is 2.3:3, and the distance between the center line of the layer of grid overfire air spouts 8 closest to the bottom of the platen superheater 3 and the center line of the adjacent downward grid overfire air spouts 10 is equal to 0.5 meter.

An angle γ is formed between the center lines of the grid overfire air spouts 8 and the normal of the water-cooled wall 2, and the grid overfire air spouts 8 are downwards adjustable within a range of $0° \leq \gamma \leq 20°$. The total amount of air passing through twelve spouts of each layer is 10% of the total amount of air required by burnout in the boiler, and the speed from the spout is 50 m/s.

According to an embodiment of the present invention, further, the grid overfire air spouts 8, the primary combustion zone two-way wall-attachment secondary air spouts 11, the primary combustion zone one-way wall-attachment secondary air spouts 10 and the reduction zone one-way wall-attachment secondary air spouts 9 operate at the same time.

The pulverized coal fired boiler with wall-attachment secondary air and grid overfire air of the present invention may effectively fulfill three objectives of reducing $NO_X$ emission of the hearth, improving the combustion efficiency and avoiding slagging and high-temperature corrosion of the hearth.

It should be noted that, the description of the present invention is merely used for exemplary illustration, but not exhaustive and limits the invention to the disclosure. It should be understood by those of ordinary skill in the art that the embodiments of the present invention may still be modified and varied without departing from the spirits of the present invention. The embodiments selected and described above are used for better explaining the principle and practical application of the present invention and being understood by those of ordinary skill in the art, so that they may design any other embodiments with various modifications which are suitable for special purpose.

The invention claimed is:

1. A pulverized coal fired boiler with wall-attachment secondary air and grid overfire air, comprising:

a hearth (1);

a water-cooled wall (2); and a platen superheater (3) arranged on the top of the hearth (1), characterized in that the hearth (1) is provided with a primary combustion zone (111), a reduction zone (112), and an burnout zone (113) from bottom to top, wherein primary burners (4) are arranged in the primary combustion zone (111), grid overfire air spouts (8) are arranged on the water-cooled wall (2) above the primary burners (4); the reduction zone (112) is a zone between the top of the primary burners (4) and the bottom of the grid overfire air spouts (8), and the burnout zone (113) is a zone between the grid overfire air spouts (8) and the bottom of the platen superheater (3), wherein a group of primary burners (4) is arranged on each of four corners of the primary combustion zone (111) of the hearth, each group of primary burners (4) comprises primary air spouts (6) and secondary air spouts (7) alternately arranged on the water-cooled wall (2) in the height direction of the hearth (1), and close coupled overfire air spouts (5) are arranged on the water-cooled wall (2) above top secondary air spouts (7), wherein the extension lines of the center lines of the primary air spouts (6) and the secondary air spouts (7) in the same height and the extension lines of the center lines of close coupled overfire air spouts (5) are respectively tangent to an imaginary circle of each layer in the center of the hearth (1) of the primary combustion zone (111);

wherein primary combustion zone two-way wall-attachment secondary air spouts (11) and primary combustion zone one-way wall-attachment secondary air spouts (10) are arranged on the water-cooled wall (2) in the primary combustion zone (111); and reduction zone one-way wall-attachment secondary air spouts (9) are arranged on the water-cooled wall (2) in the reduction zone (112).

2. The boiler according to claim 1, characterized in that it is provided with at least three layers of primary air spouts (6) and secondary air spouts (7), wherein the lowest layer is the first layer, and wherein one or more layers of primary combustion zone two-way wall-attachment secondary air spouts (11) are arranged on the water-cooled wall (2) between the first layer of primary air spouts ($Y_1$) and the third layer of primary air spouts ($Y_3$).

3. The boiler according to claim 2, characterized in that it is provided with one or more layers of primary combustion zone two-way wall-attachment secondary air spouts (11), wherein each layer of primary combustion zone two-way wall-attachment secondary air spouts (11) comprises four primary combustion zone two-way wall-attachment secondary air spouts (11), and one primary combustion zone two-way wall-attachment secondary air spout (11) is arranged at the same elevation of each wall of the water-cooled wall (2); and the speed of air spouted from the primary combustion zone two-way wall-attachment secondary air spouts (11) is more than 40 m/s.

4. The boiler according to claim 3, characterized in that air outlet nozzles of the primary combustion zone two-way wall-attachment secondary air spouts (11) are symmetrically arranged on the left and right sides of a center line which is the normal of the water-cooled wall (2), and wherein the angles between the center lines of the air outlet nozzles of the primary combustion zone two-way wall-attachment secondary air spouts (11) and the normal of the water-cooled wall (2) are $\alpha_{left}$ and $\alpha_{right}$ respectively, wherein $\alpha_{left}$ is equal to $\alpha_{right}$; and the adjustment range of the center lines of the air outlet nozzles is $15° \leq \alpha_{left} \leq 80°$.

5. The boiler according to claim 2, characterized in that at least three layers of primary combustion zone one-way wall-attachment secondary air spouts (10) are arranged between the third layer of primary air spouts ($Y_3$) and the close coupled overfire air spouts (5) on the water-cooled wall (2) on two sides of the secondary air spouts (7) and the close coupled overfire air spouts (5), wherein primary combustion zone one-way wall-attachment secondary air spouts (10) of each layer are arranged at the same elevation of the water-cooled wall (2), and two primary combustion zone one-way wall-attachment secondary air spouts are symmetrically arranged relative to the secondary air spouts (7) and the close coupled overfire air spouts (5); and wherein the speed of air spouted from the primary combustion zone one-way wall-attachment secondary air spouts (10) is more than 35 m/s.

6. The boiler according to claim 5, characterized in that an angle β is formed between the center lines of the primary combustion zone one-way wall-attachment secondary air spouts (10) and the water-cooled wall (2), and the adjustment range of the angle β is $0° \leq \beta \leq 20°$.

7. The boiler according to claim 1, characterized in that at least one layer of the reduction zone one-way wall-attachment secondary air spouts (9) is arranged on the water-cooled wall (2) in the reduction zone (112), wherein the reduction zone one-way wall-attachment secondary air spouts (9) located in the same layer are arranged at the same height, and two reduction zone one-way wall-attachment secondary air spouts (9) are symmetrically arranged on each corner of the water-cooled wall (2), and wherein the speed of air spouted from the reduction zone one-way wall-attachment secondary air spouts (9) is 25 to 50 m/s.

8. The boiler according to claim 7, characterized in that an angle β' is formed between the center lines of the reduction zone one-way wall-attachment secondary air spouts (9) and a wall surface of the water-cooled wall (2); and the adjustment range of the angle β' is $0° \leq \beta' \leq 15°$.

9. The boiler according to claim 1, characterized in that at least two layers of the grid overfire air spouts (8) are arranged on the water-cooled wall (2) in the burnout zone (113), wherein at least three grid overfire air spouts (8) of each layer are arranged at the same height of each wall of the water-cooled wall (2); and wherein the spout center lines of the grid overfire air spouts (8) are perpendicular to the wall surface of the water-cooled wall (2) where the grid overfire air spouts (8) are located.

10. The boiler according to claim 9, characterized in that the distance between the center lines of two adjacent grid overfire air spouts (8) located on the first wall of the water-cooled wall (2) and belonging to the same layer is equal to the distance between the center line of the grid overfire air spout (8) closest to the second wall of the water-cooled wall (2) and the second wall of the water-cooled wall (2), wherein the first wall of the water-cooled wall (2) is perpendicular to the second wall of the water-cooled wall (2).

11. The boiler according to claim 9, characterized in that the ratio of the distance ($h_R$) between the center line of the grid overfire air spout (8) closest to the bottom of the platen superheater (3) and the center line of the top layer of primary air spouts ($Y_6$) to the distance ($h_p$) between the bottom of the platen superheater (3) and the center line of the top layer of primary air spouts ($Y_6$) is 2.5:3 to 1.5:3; and wherein the intervals of the countering grid overfire air spouts (8) of each layer are more than or equal to 0.5 m.

12. The boiler according to claim 9, characterized in that an angle γ is formed between the center lines of the grid overfire air spouts (8) and the normal of the wall surface of the water-cooled wall (2); and the grid overfire air spouts (8) are downwards adjustable within a range of $0° \leq \gamma \leq 20°$.

13. The boiler according to claim 9, characterized in that the total amount of air passing through each layer of the grid overfire air spouts (8) is 5 to 25% of the total amount of air required by combustion in the boiler; and the speed of air spouted from the grid overfire air spouts (8) is 20 to 50 m/s.

14. The boiler according to claim 1, characterized in that the grid overfire air spouts (8), the primary combustion zone two-way wall-attachment secondary air spouts (11), the primary combustion zone one-way wall-attachment secondary air spouts (10) and the reduction zone one-way wall-attachment secondary air spouts (9) operate at the same time.

* * * * *